US006850190B2

(12) United States Patent
Ryu et al.

(10) Patent No.: US 6,850,190 B2
(45) Date of Patent: Feb. 1, 2005

(54) COMBINED BEAMFORMING-DIVERSITY WIRELESS FADING CHANNEL DEMODULATOR USING ADAPTIVE SUB-ARRAY GROUP ANTENNAS, SIGNAL RECEIVING SYSTEM AND METHOD FOR MOBILE COMMUNICATIONS

(75) Inventors: Kil-hyen Ryu, Suwon (KR); Suk-won Kim, Uiwang (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/717,057

(22) Filed: Nov. 19, 2003

(65) Prior Publication Data

US 2005/0001765 A1 Jan. 6, 2005

(30) Foreign Application Priority Data

Jul. 3, 2003 (KR) ..... 10-2003-0044851

(51) Int. Cl.[7] ..... H01Q 3/00
(52) U.S. Cl. ..... 342/377; 342/383; 329/317
(58) Field of Search ..... 342/377, 378, 342/383; 375/136, 143, 144; 329/302, 317, 323, 346; 455/130, 312

(56) References Cited

U.S. PATENT DOCUMENTS 5,676,147 A * 10/1997 Petrofsky et al. ..... 600/447
5,796,779 A * 8/1998 Nussbaum et al. ..... 375/267
6,473,037 B2 10/2002 Vail et al.
6,504,515 B1 * 1/2003 Holt et al. ..... 343/853
2001/0028675 A1 * 10/2001 Bierly et al. ..... 375/143
2003/0224751 A1 * 12/2003 Vanderhelm et al. ..... 455/296
2004/0027268 A1 * 2/2004 Langsford ..... 342/16

FOREIGN PATENT DOCUMENTS

WO WO 9856068 10/1998

OTHER PUBLICATIONS

English Abstract for WO98/56068.

* cited by examiner

*Primary Examiner*—Dao Phan
(74) *Attorney, Agent, or Firm*—F. Chau & Associates, LLC

(57) ABSTRACT

A wireless fading-channel demodulator using adaptive sub-array group antennas to combine beamforming and diversity gain, a signal receiving system and method for mobile communications using the wireless fading-channel demodulator. The wireless fading-channel demodulator eliminates interference signals arriving at different directions-of-arrival (DOAs) from undesired mobile stations (users) and provides strong immunity to fading. A high signal and interference-to-noise ratio SINR can be achieved even when the number of antennas is smaller than the number of mobile stations (users). The wireless fading channel modulator can be applied to any system receiving mobile communication information, such as a base station, a mobile station, etc.

20 Claims, 4 Drawing Sheets

COMBINED BEAMFORMING-DIVERSITY WIRELESS FADING CHANNEL DEMODULATOR USING ADAPTIVE SUB-ARRAY GROUP ANTENNAS, SIGNAL RECEIVING SYSTEM AND METHOD FOR MOBILE COMMUNICATIONS

BACKGROUND OF THE INVENTION

1. Field of the Invention

The present invention relates to a signal receiving system for mobile communications, and more particularly, to a combined beamforming-diversity system using adaptive array antennas for a wireless fading channel environment.

2. Description of the Related Art

Beamforming systems using adaptive array antennas are commonly used as mobile communications systems for military radars. Beamforming systems are emerging as popular third-generation portable communication systems for consumers. Beamforming systems provide a fixed array of antennas to track mobile transmitters and reduce cochannel interference (CCI). Code Division Multiple Access (CDMA) based systems may dominate the new generation of mobile cellphone systems. Such a multiple access technique may provide robust high-rate communication, enabling rich data services for mobile cellphone consumers. As increased bandwidth is demanded by those consumers, communications systems must provide even higher data rates within the same amount of radio spectrum, and therefore increasingly spectrally-efficient systems must be devised. One of the main strategies used to increase CDMA system capacity is the use of multiple transmit and/or receive antennas, known as beamforming antenna arrays. The throughput of code division multiple access (CDMA) systems, which is degraded by interference signals from other users, can be increased with the beamforming system. As the number of users increases, the performance and reliability of conventional beamforming CDMA installations may be degraded. A conventional beamforming system is disclosed in detail in U.S. Pat. No. 6,336,033.

FIG. 1 illustrates a wireless fading channel model of a conventional beamforming system. With respect to FIG. 1, when a receiving system of a base station BS with an adaptive array antenna receives communication information from a desired mobile station MS1, signal interference appears due to another mobile station MS2 or reflection sources C and D. Here, the mobile stations MS1 and MS2 include all types of wireless fading channel communication systems, such as mobile phones, wireless LAN cards, vehicle navigation systems, and the like. A general beamforming system is used in a wireless fading channel environment via an adaptive array antenna including tens of antennas arranged at constant intervals. Accordingly, the beamforming system has a better signal and interference-to-noise ratio (SINR) since many interference signals arriving at various angles, which originate from another mobile station MS1 or reflection sources C and D, can be eliminated.

The performance of such mobile communication systems is greatly influenced by a fading effect due to various reflection sources in a wireless channel and interference signals from other mobile stations (users). The beam shape (A) of a target signal received in the base station BS of FIG. 1 is affected by the beams B of interference signals generated by the fading effect. In the beamforming system of FIG. 1 using an adaptive array antenna, fading can be alleviated to some extent by eliminating interference signals reflected from relatively far away reflection sources C and D. However, the reduction of the fading effect using only the adaptive antenna array, as in this case, is quite limited. In an urban communication environment where a base station for most mobile communication systems is located high above mobile stations, most signals transmitted from the mobile stations are reflected near the mobile stations and are received by the base station at a very small direction of arrival (DOA). As a result, the beam A of a desired user's signal can be undistinguishable from the beams of the reflected signals having similar DOAs and undergoes phase interference with the reflected signals, so that the fading effect causing sharp signal fluctuations within a short time cannot be overcome. In addition, when the number of antennas in the conventional beamforming system is smaller than the number of mobile stations (users), the SINR is lowered due to a reduced degree of freedom.

SUMMARY OF THE INVENTION

The present invention provides a wireless fading channel demodulator that eliminates interference signals arriving at various directions-of-arrival (DOAs) from other mobile stations (users) in a wireless fading channel environment. Also, the system of the present invention provides a high signal and interference-to-noise ratio (SINR) due to immunity to fading and the beamforming properties of an adaptive sub-array group antenna, even when the number of antennas is smaller than the number of mobile stations (users).

The present invention also provides a signal receiving system for mobile communications that includes the wireless fading channel demodulator.

The present invention also provides a method for demodulating a signal transmitted over a wireless fading channel, in which adaptive sub-array group antennas are used to combine beamforming and diversity gain. Interference signals arriving at various directions-of-arrival (DOAs) from other mobile stations (users) in a wireless fading channel environment can be eliminated, and a high signal and interference-to-noise ratio (SINR) can be achieved even when the number of antennas is smaller than the number of mobile stations.

The present invention also provides a signal receiving method for mobile communication.

In accordance with an aspect of the present invention, there is provided a wireless fading channel demodulator comprising a receiving-processing portion, a signal magnitude and phase processing portion, a final beam output portion, and a weighted vector calculation portion. The receiving-processing portion receives and converts sub-array group analog communication signals, which are received via M sub-array groups, into digital input signals, multiplies the digital input signals by corresponding weighted vector elements, and sums the products for each sub-array group to generate M diversity-beamforming signals. The signal magnitude and phase processing portion multiplies the magnitude and phase of a representative digital input signal for each sub-array group by the corresponding one of the M diversity-beamforming signal and outputs the M products. The final beam output portion sums all output signals from the signal magnitude and phase processing portion and outputs a final output (beamforming) signal. The weighted vector calculation portion calculates, from the digital input signals, a weighted vector that comprises the weighted vector elements, selects the representative digital input signal for each sub-array group from among the digital input signals, and calculates and outputs the magnitude and phase of each of the selected representative digital input signals.

According to specific embodiments of the wireless fading channel demodulator, the receiving-processing portion comprises a plurality (M) of beamformers which convert the analog communication signals received from the corresponding sub-array groups into the digital input signals and generate the M diversity-beamforming signals using the digital input signals and the corresponding weighted vector elements. Each of the beamformers may comprise analog-to-digital (A/D) converters, multipliers, and an adder. The analog-to-digital (A/D) converters convert the analog communication signals received via the corresponding sub-array groups into the digital input signals and output the digital input signals. The multipliers multiply the digital input signals for each sub-array group by the corresponding weighted vector elements and outputs the products. The adder sums the products for each sub-array group, which are output from the multipliers, and outputs one of the M diversity-beamforming signals.

Each of the sub-array groups comprises a plurality (L) of antennas, which receive wireless fading channel signals, in a sub-array, and the spacing (i.e., distance) between the L antennas in each sub-array group may be smaller than the spacing between the M sub-array groups.

The weighted vector may be calculated using the following equations:

$$u_m=[u_{m1}, u_{m2}, \ldots, u_{mL}]^T$$

$$R_m=E[u_m\, u_m^H]$$

$$w_{m,opt}=\frac{R_m^{-1}s_{m1}}{s_{m1}^H R_m^{-1} s_{m1}}$$

where $u_{mL}$ denotes an $L^{th}$ digital input signal of an $m^{th}$ sub-array group, superscript "T" means transformation into a column vector, E[ ] denotes the mean value, $w_{m,opt}$ denotes a weighted vector for the $m^{th}$ sub-array group, and $s_{m1}$ denotes a steering vector based on the direction-of-arrival (DOA) of a representative digital input signal from the $m^{th}$ sub-array group.

In accordance with another aspect of the present invention, there is provided a signal receiving system for mobile communications that comprises a plurality of sub-array groups, a radio frequency module unit, and a wireless fading channel demodulation unit. Each of the plurality (M) of sub-array groups includes a plurality (L) of antennas in a sub-array and receives wireless signals via assigned wireless fading channels. The radio frequency module unit extracts analog communication signals from the received wireless signals and outputs the extracted analog signals as sub-array group analog communication signals. The wireless fading channel demodulation unit receives and converts the sub-array group analog communication signals into digital input signals, generates M diversity-beamforming signals using the digital input signals and weighted vector elements, and outputs a final output signal using the magnitude and phase of a representative digital input signal of each of the M sub-array groups and a corresponding one of the M diversity-beamforming signals.

According to specific embodiments of the signal receiving system, the signal receiving system may further comprise a relay processor that processes the final output signal to relay wireless communications between mobile stations over the assigned wireless fading channels. Alternatively, the signal receiving system may further comprise a display signal output unit that processes the final output signal to output a display signal that drives a display device of a mobile station.

The wireless fading channel demodulation unit comprises a receiving-processing portion, a signal magnitude and phase processing portion, a final beam output portion, and a weighted vector calculation portion. The receiving-processing portion receives and converts the sub-array group analog communication signals, which are received via M sub-array groups, into digital input signals, multiplies the digital input signals by corresponding weighted vector elements, and sums the products for each sub-array group, to generate M diversity-beamforming signals. The signal magnitude and phase processing portion multiplies the magnitude and phase of a representative digital input signal for each of the M sub-array groups by the corresponding one of the M diversity-beamforming signals and outputs the M products. The final beam output portion sums all M the products output from the signal magnitude and phase processing portion and outputs a final output signal. The weighted vector calculation portion: calculates a weighted vector, which comprises the weighted vector elements, from the digital input signals; and selects the representative digital input signal from among the digital input signals for each sub-array group; and calculates and outputs the magnitude and phase of the selected representative digital input signal.

In the signal receiving system, the spacing between the L antennas in each sub-array group may be smaller than the spacing between the M sub-array groups.

In accordance with another aspect of the present invention, there is provided a method for demodulating a signal transmitted over a wireless fading channel, the method comprising: (a) receiving sub-array group analog communication signals that are received via M sub-array groups, and converting the sub-array group analog communication signals into digital input signals, multiplying the digital input signals by corresponding weighted vector elements, and summing the products for each sub-array group to generate M diversity-beamforming signals; (b) multiplying the magnitude and phase of a representative digital input signal for each sub-array group by the corresponding one of the M diversity-beamforming signals and outputting the product; (c) summing all of the products obtained in step (b) to output a final output signal; and (d) calculating (from the digital input signals) a weighted vector that comprises the weighted vector elements, and selecting a representative digital input signal from among the digital input signals for each of the M sub-array groups, and calculating and outputting the magnitude and phase of each of the M selected representative digital input signals.

In accordance with still another aspect of the present invention, there is provided a signal receiving method for mobile communications, the method comprising: (a) a plurality (M) of sub-array groups, each of which includes a plurality of (L) antennas in a sub-array receiving wireless signals via assigned wireless fading channels; (b) extracting analog communication signals from the received wireless signals and outputting the extracted analog signals as sub-array group analog communication signals; and (c) receiving and converting the sub-array group analog communication signals into digital input signals, generating M diversity-beamforming signals using the digital input signals and weighted vector elements of a weighted vector, and outputting a final output signal using the magnitude and phase of a representative digital input signal of each of the M sub-array groups and corresponding ones of the M diversity-beamforming signals, to demodulate the sub-array group analog communication signals received via a wireless fading channel. In the signal receiving method, step (c) comprises: (c1) generating the diversity-beamforming signals; (c2) multiplying the magnitude and phase of a representative digital input signal for each sub-array group by the corresponding diversity-beamforming signal and outputting the products; (c3) summing all of the products to output the final output signal; and (c4) calculating the weighted vector comprising (M×L) weighted vector elements from the digital input signals, selecting M representative digital input signals from among the digital input signals, and calculating and outputting the magnitude and phase of each of the M selected representative digital input signals.

The space between the antennas in each sub-array group used to receive signals in the above method may be smaller than the space between the sub-array groups.

BRIEF DESCRIPTION OF THE DRAWINGS

The above objects and advantages of the present invention will become more apparent by describing in detail exemplary embodiments thereof with reference to the attached drawings in which.

DETAILED DESCRIPTION OF THE INVENTION

Figure 1:
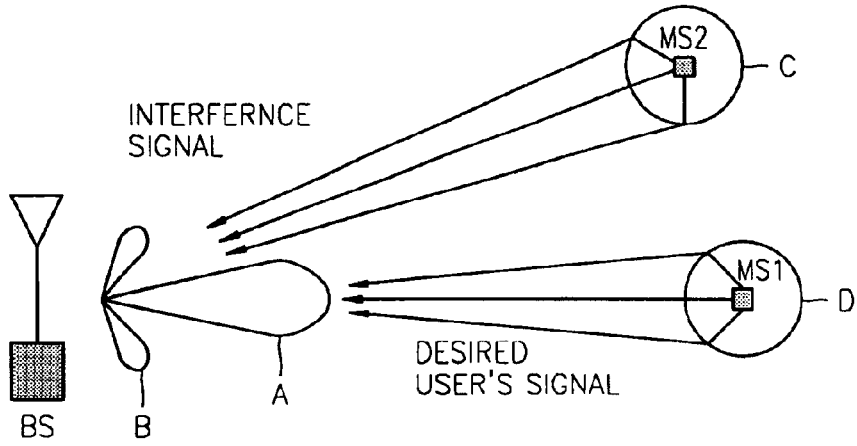
FIG. 1 illustrates a wireless fading channel model of a conventional beamforming wireless system.

The preferred embodiments of the present invention will be described with reference to the appended drawings. Identical reference numerals have been used, where possible, to designate identical elements that are common to the drawings. The numerical terms "M", "L" and "N" used hereinbelow (e.g., "$M^{th}$") refer to positive integers. The terms "wireless fading channel demodulator" and "wireless fading channel demodulation unit" used throughout the specification are used interchangeably to describe an apparatus for demodulating a signal transmitted over a wireless fading channel.

Figure 2:
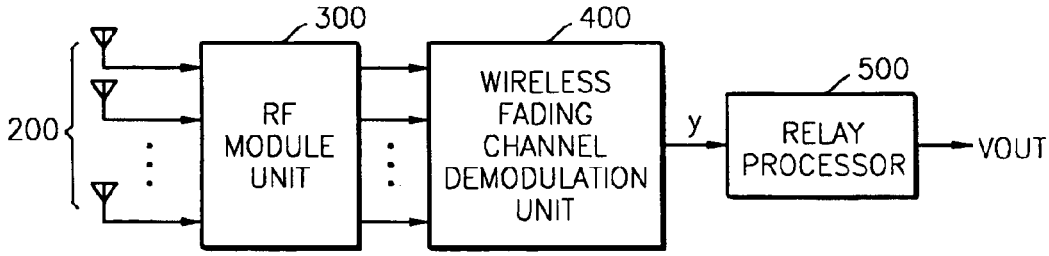
FIG. 2 is a block diagram of a signal receiving system, for mobile communications, that includes a wireless fading channel demodulation unit according to an embodiment of the present invention.

Referring to FIG. 2, a signal receiving system for mobile communications according to an embodiment of the present invention includes sub-array groups 200, a radio frequency (RF) module unit 300, and a wireless fading channel demodulation unit 400. The signal receiving system for mobile communications may further include a relay processor 500 when used for a base station. Alternatively, the mobile communication system may further include a display signal output unit (not shown) instead of the relay processor 500 when used for a mobile station, such as a mobile phone, a wireless LAN card, or a vehicle navigation system.

Figure 3:
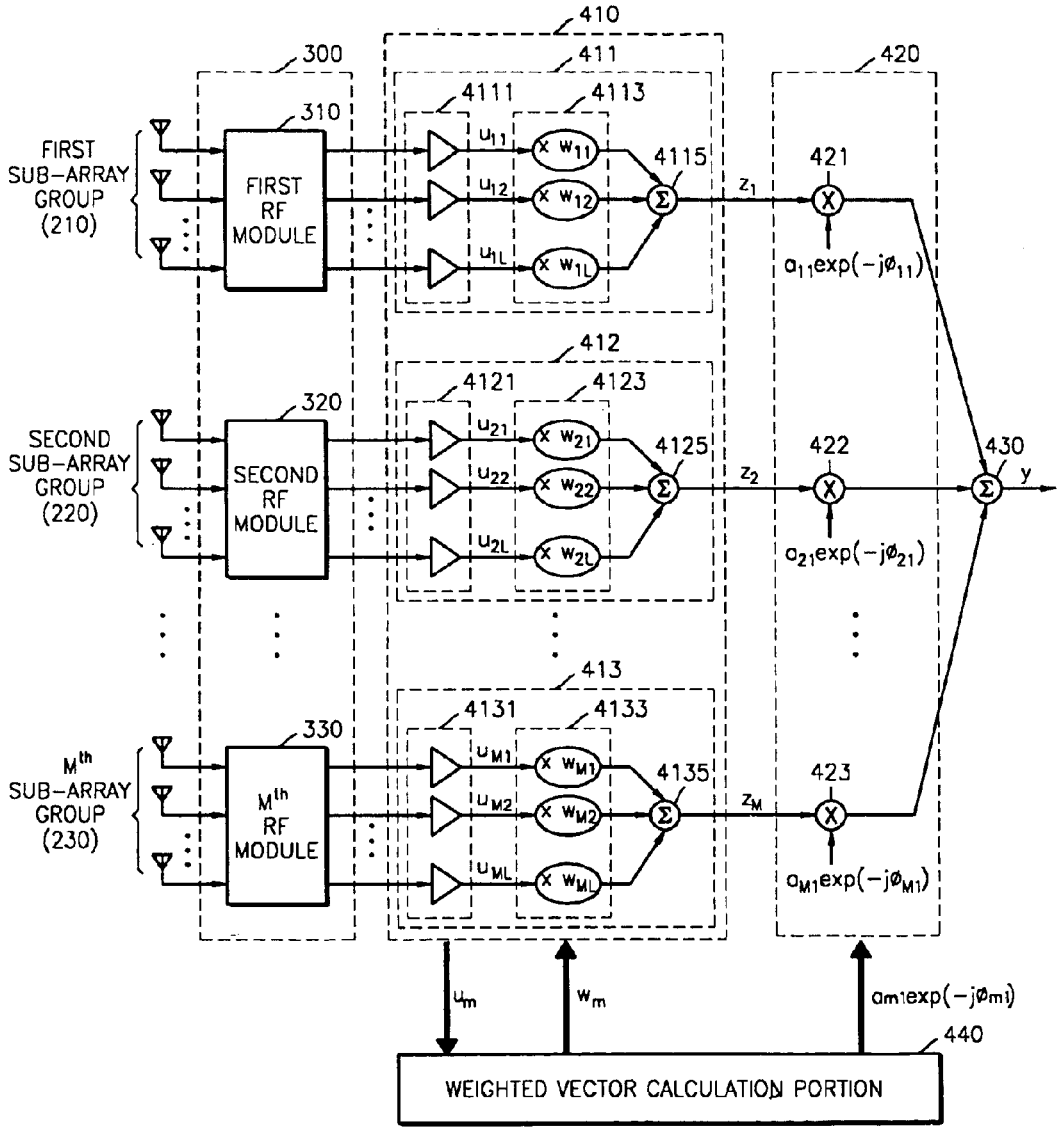
FIG. 3 is a detailed block diagram depicting the antenna sub-array groups, the radio frequency (RF) module unit, and the wireless fading channel demodulation unit (410, 420, 430, 440) of FIG. 2.
Figure 4:
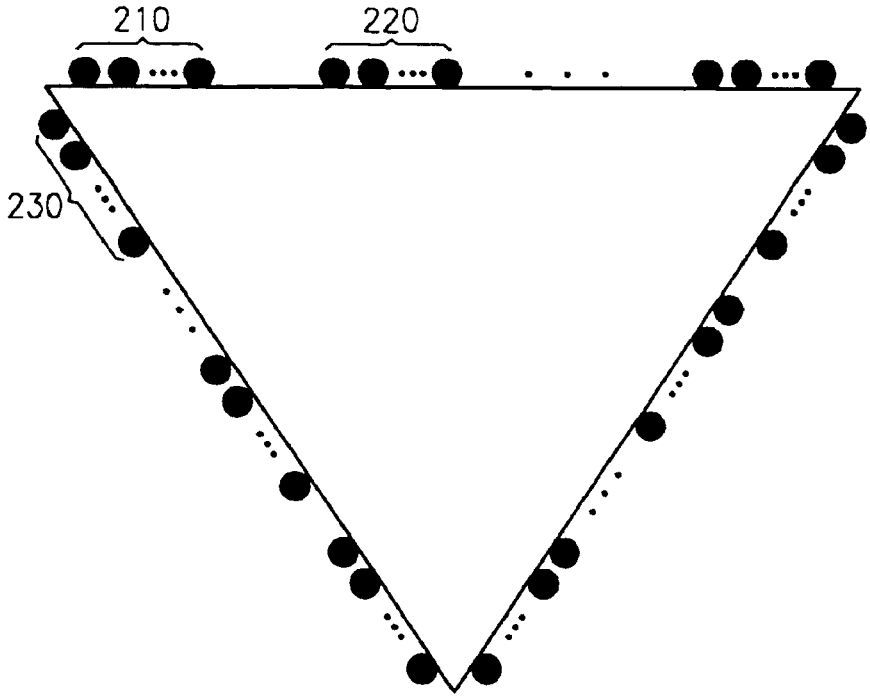
FIG. 4 illustrates a first arrangement of antennas based on space diversity in a mobile communication base station system having three sectors.
Figure 5:
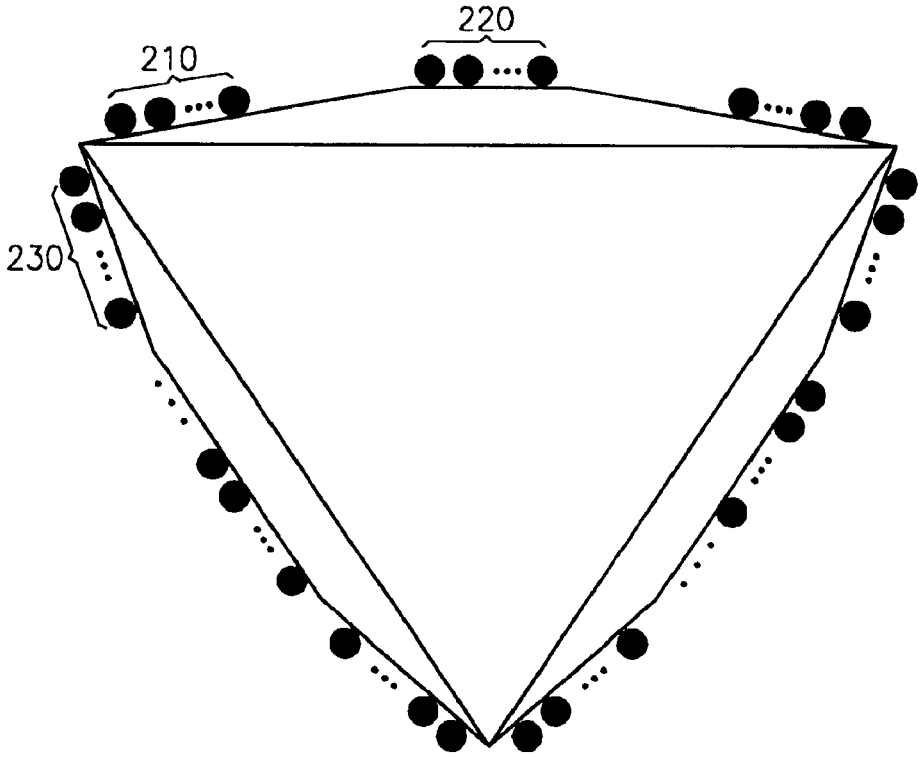
FIG. 5 illustrates a second arrangement of antennas based on direction-of-arrival diversity in a mobile communication base station system having three sectors.

A "sub-array group" refers to a sub-array of a plurality (L) of antennas arranged in groups (as depicted in FIGS. 4 and 5) that receive wireless fading channel signals (as depicted in FIG. 3), wherein the space (distance) between the L antennas within each sub-array group is smaller than the space between each of the M sub-antenna groups. For example, the L antennas within each sub-array group may be spaced less than half of a transmission signal wavelength apart, while the M sub-antenna groups may be spaced ten or greater times the transmission signal wavelength apart.

For example, when a plurality (M×L) of antennas arranged as three sectors, as shown in FIG. 4 or 5, are grouped into a plurality (M) of sub-array groups (e.g., 210, 220, . . . , 230), the space between the antennas within each sub-array group must be smaller than the space between the sub-array groups. For example, the space between the antennas (shown as black dots in FIGS. 4 and 5) in each sub-array group may be half of a transmission signal wavelength, and the space between the sub-array groups (e.g., 210, 220, 223) may be 10 times the transmission signal wavelength. This configuration is for improving immunity to fading in a wireless fading channel environment and for providing a higher SINR, based on the fact that the correlation between signals received by the antennas in the same sub-array group is high and that the correlation between signals received by the different sub-array groups is low. In general, in the antenna configuration shown in FIG. 4 or 5, the lower the correlation between the signals received by different sub-array groups, the larger the SINR. This relationship is stronger in the antenna configuration of FIG. 5 utilizing angle (DOA) diversity than in the antenna configuration of FIG. 4 utilizing only space diversity.

FIG. 3 depicts a detailed block diagram of the sub-array groups 200, the RF module unit 300, and the wireless fading channel demodulation unit 400 (comprising components 410, 420, 430 and 440).

The sub-array groups 200 comprise a plurality (M) sub-array antenna groups, including first sub-array group 210, second sub-array group 220, . . . , and an $M^{th}$ sub-array group 230. The sub-array groups 200 receive wireless signals over assigned wireless fading channels.

The RF module unit 300 extracts an analog communication signal from each of the wireless signals received via the sub-array groups 200 and outputs the extracted analog communication signals. The RF module unit 300 comprises a plurality (M) of RF modules (e.g., 310, 320, 330), wherein each RF Module extracts a plurality (L) of analog communication signals from one of the M antenna sub-array groups (e.g., 210, 220, 230 respectively). A first RF module of the RF module unit 300 extracts an analog communication signal from each of a plurality (L) of signals received in the first sub-array group 210 and outputs the extracted analog communication signals as a first plurality (L) of sub-array group analog communication signals. Likewise, a second RF module 320, . . . , and an $M^{th}$ RF module 330 extract analog communication signals from the corresponding sub-array groups 220 through 230 and output second through $M^{th}$ pluralities of L sub-array group analog communication signals.

The wireless fading channel demodulation unit 400 includes a receiving-processing portion 410, a signal magnitude and phase processing portion 420, a final beam output portion 430, and a weighted vector calculation portion 440.

The wireless fading channel demodulation unit 400 receives and converts the (M×L) sub-array group analog communication signals into (M×L) digital input signals ($u_{11}$, $u_{12}$, . . . , $u_{1L}$), generates M diversity-beamforming signals ($z_1$, $z_2$, . . . , $z_M$) using the (M×L) digital input signals, and weighted vector elements ($w_{11}$, $w_{12}$, . . . , $w_{1L}$), and outputs a final output signal y using the magnitude and phase of a representative digital input signal (from) from each of the M sub-array groups and the corresponding diversity-beamforming signal.

The receiving-processing portion 410 includes a plurality (M) of beamformers (411, 412, . . . , 413). Each of the beamformers (411, 412, . . . , 413) include groups of analog-to-digital converters (A/Ds) (4111, 4121, . . . , 4131), groups of multipliers (4113, 4112, . . . , and 4133), and an adder (4115, 4125, . . . , 4135, respectively). The A/D converters 4111, 4121, . . . , 1431 convert the analog communication signals received from the respective sub-array groups into digital input signals (for example, $u_{11}$, $u_{12}$, . . . , $u_{1L}$) and output the digital input signals. The multipliers 4113, 4123, . . . , 4133 multiply the digital input signals (for example, $u_{11}$, $u_{12}$, . . . , $u_{1L}$) for each sub-array group by corresponding weighted vector elements, (for example, $w_{11}$, $W_{12}$, . . . , $W_{1L}$), and outputs the products. The adders 4115, 4125, . . . , 4135 sum the products for each sub-array group, which are output from the multipliers 4113, 4123, . . . , and 4133, and output the diversity-beamforming signals $z_1$, $z_2$, . . . , $z_M$.

Each of the M beamformers (411, 412, . . . , 413) receives and converts L sub-array group analog communication signals into (L) digital input signals (for example, $u_{11}$, $u_{12}$, . . . , $u_{1L}$), multiplies each of the L digital input signals by corresponding weighted vector elements (for example, $w_{11}$, $w_{12}$, . . . , $w_{1L}$), sums the products thereof (for one of the M sub-array groups), and outputs the resulting sum as one of M diversity beamforming signals, (e.g., $z_1$, $z_2$, or $z_M$).

In other words, the receiving-processing portion 410 includes a plurality (M) of beamformers 411, 412, . . . , 413, each of which converts L analog communication signals received from the corresponding one of the M sub-array groups into L digital input signals (for example, $u_{11}$, $u_{12}$, . . . , $u_{1L}$) and generates M diversity-beamforming signals $z_1$, $z_2$, . . . , $z_M$. Each of the M diversity beamforming signals ($z_1$, $z_2$, . . . , $z_M$) are formed using one group of L digital input signals (for example, $u_{11}$, $u_{12}$, . . . , $u_{1L}$), and one group of L corresponding weighted vector elements (for example, $w_{11}$, $w_{12}$, . . . , $w_{1L}$).

The weighted vector calculation portion 440 calculates the weighted vector elements (e.g., $w_{11}$, $w_{12}$, . . . , $W_{1L}$) using Equations 1, 2, and 3 below.

$$u_m=[u_{m1}, u_{m2}, \ldots, u_{mL}]^T \quad \text{Equation 1}$$

$$R_m=E[u_m\, u_m^H] \quad \text{Equation 2}$$

$$w_{m,opt} = \frac{R_m^{-1} s_{m1}}{s_{m1}^H R_m^{-1} s_{m1}} \quad \text{Equation 3}$$

In Equation 1 above, $u_{mL}$ denotes the $L^{th}$ digital input signal of the $m^{th}$ sub-array group, and um is a column vector including the digital input signals of the $m^{th}$ sub-array group as elements, and T means transformation into the column vector. The digital input signals can be generalized using a transmission signal $x_k$ as expressed in Equation 4 below.

$$u_{mL} = \sum_{k=1}^{K} x_k a_{mk} e^{j\phi_{mk}} e^{j\psi_{m1}(\theta_{mk})} + n \quad \text{Equation 4}$$

In Equation 4 above, $x_k$ denotes a complex modulation signal transmitted from the $k^{th}$ user mobile station, $\alpha_{mk}$ denotes the magnitude and $e^{j\Phi_{mk}}$ denotes the phase of an input signal received over a wireless fading channel and processed, respectively, $\Phi_{m1}$ denotes the phase delay of a first digital input signal of the $m^{th}$ sub-array group, $\theta_{mk}$ denotes the direction-of-arrival (DOA) of a signal transmitted from the $k^{th}$ user mobile station and received via the $m^{th}$ sub-array group, and n denotes additive white Gaussian noise.

In Equation 2 above, $R_m$ denotes an array correlation matrix, E[ ] denotes the mean value, and H means the Hermitian vector.

In Equation 3 above, $w_{m,opt}$ denotes a weighted vector for the $m^{th}$ sub-array group, $s_{m1}$ denotes a steering vector based on the direction-of-arrival (DOA) of a representative digital input signal from the $m^{th}$ sub-array group. The weighted vector $w_{m,opt}$, which is optimized for beamforming, satisfies the requirements for minimizing the output power of each of the sub-array groups and for maintaining the value of an output signal in the beamforming direction.

The signal magnitude and phase processing portion 420 multiplies the magnitude (a) and phase ($e^{j\Phi}$) of a representative digital input signal (u) for each sub-array group. For example a multiplier 421 in the signal magnitude and phase processing portion 420, multiplies the magnitude ($a_{11}$) and phase ($e^{j\Phi}{}_{11}$) of representative digital input signal $u_{11}$ (representative of the first sub-array group 210), by the corresponding diversity-beamforming signal ($z_1$) and outputs the product. Each representative digital input signal may be any one selected from among the L digital input signals corresponding to a respective sub-array group.

The final beam outputting portion 430 sums the signals output from the signal magnitude and phase processing portion 4200 and outputs the final output signal y. The final output signal y is the result of maximum ratio combination (MRC), expressed as Equation 5 below, using the output signals from the signal magnitude and phase processing portion 420.

$$y = \sum_{m=1}^{M} a_{m1} e^{-j\phi_{m1}} z_m \quad \text{Equation 5}$$

The weighted vector calculation portion 440 calculates and outputs the weighted vector from the digital input signals, selects the representative digital input signal from among the digital input signals for each sub-array group, for example, $u_{11}$ for the first sub-array group 210, and calculates and outputs the magnitude and phase of the selected representative digital input signal.

As described above, the mobile communication receiving system may further comprise the relay processor 500 when used in a base station. The relay processor 500 processes the final output signal y to relay wireless communications between mobile stations over the assigned wireless fading channels. The mobile communication receiving system may further comprise a display signal output unit (not shown), instead of the relay processor 500, when used in a mobile station, such as a mobile phone, a wireless LAN card, or vehicle navigation system. The display signal output unit processes the final output signal y to output a display signal that drives a display device of the mobile station. In FIG. 2, VOUT denotes the output signal from the relay processor 500 or from the display signal output unit.

Figure 6:
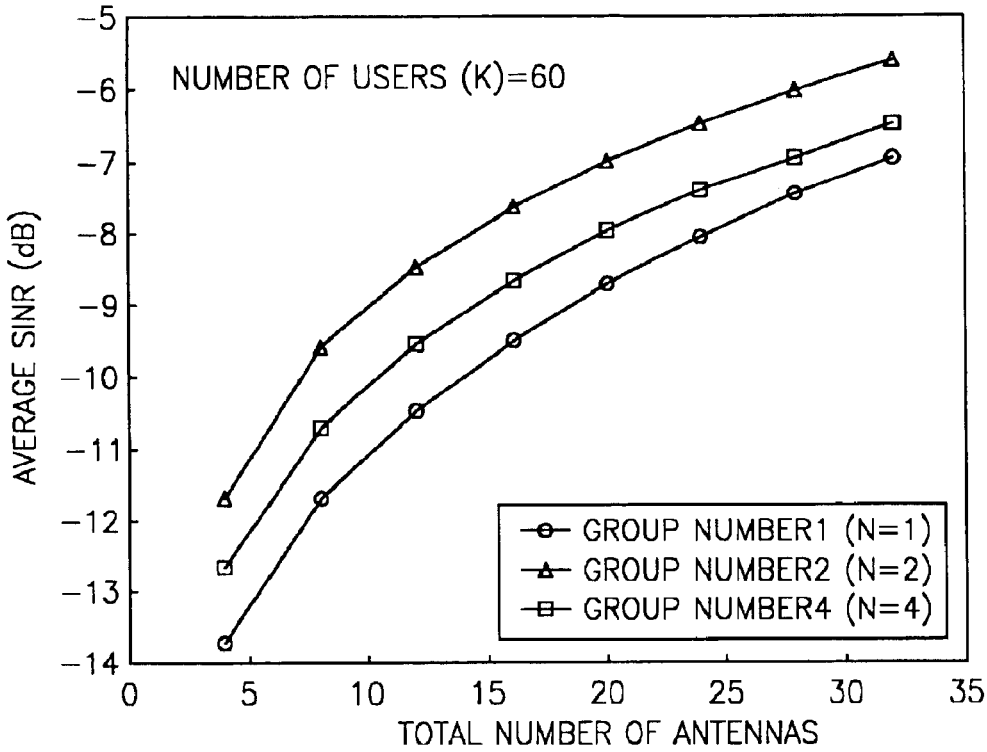
FIG. 6 is a graph depicting signal and interference-to-noise ratio (SINR) as a function of the number of antenna sub-array groups in a signal receiving system for mobile communications according to the present invention.

FIG. 6 is a graph depicting the average SINR gain versus number of antennas in the mobile communication receiving system according to the present invention. In FIG. 6, the number of users (mobile stations) is 60, and the number of antennas in each sub-array group, N, was varied to 1, 2, and 4. The average SINR is larger for N=2 or N=4 than for N=1. In addition, although the number of users is smaller than the total number of antennas, the average SINR is large. The case of N=1 corresponds to a conventional antenna array including antennas arranged at a constant interval without being grouped into sub-arrays.

As described above with reference to FIG. 2, the mobile communication receiving system with the wireless fading channel demodulation unit 400 according to the present invention receives analog communication signals via sub-array group antennas, converts the analog communication signals into digital input signals, generate diversity-beamforming signals $z_1, z_2, \ldots, z_M$ using the digital input signals, for example, $u_{11}, u_{12}, \ldots, u_{1L}$ and the corresponding weighted vector elements, for example, $w_{11}, w_{12}, \ldots, w_{1L}$, and outputs a final output signal y. The system generates the final output signal y using the magnitude and phase of a representative digital input signal that is selected from among the digital input signals for each sub-array group, and the corresponding diversity-beamforming signal. The final output signal y may be transmitted to the relay processor 500, which relays wireless communications between mobile stations, or a display signal output unit (not shown), which outputs a display signal driving a display device of a mobile station.

As described above, a wireless fading channel demodulator according to the present invention can eliminate interference signals entering the base station from undesired mobile stations at different DOAs in a wireless fading channel environment using combined beamforming and diversity gain and using adaptive sub-array group antennas. Therefore, a high SINR can be obtained due to strong immunity to fading and the beamforming properties improved by the method and apparatus of the present invention, even when the number of antennas is smaller than the number of mobile stations (users). The wireless fading channel modulator of the present invention can be applied to any system receiving mobile communication information, such as a base station, a mobile station, etc.

In the drawings and specification, there have been disclosed exemplary embodiments of the invention and, although specific terms are employed, they are used in a generic and descriptive sense only and not for purposes of limitation. It will be understood by those skilled in the art that various changes in form and detail without departing from the spirit and scope of the invention as defined by the appended drawings. Accordingly, the scope of the invention is defined as indicated in the following claims, in which "M" (and "m") and "L" are positive integers, and "x" denotes the multiplication thereof.

What is claimed is:

1. A wireless fading-channel demodulator comprising:

a receiving-processing portion which receives and converts sub-array group analog communication signals that are received via M antenna sub-array groups, into digital input signals, multiplies the digital input signals by corresponding weighted vector elements, and sums the products for each sub-array group to generate M diversity-beamforming signals;

a signal magnitude and phase processing portion which multiplies the magnitude and phase of a representative digital input signal for each of the M sub-array groups by the corresponding one of the M diversity-beamforming signals and outputs the M products;

a final beam output portion which sums the M products output from the signal magnitude and phase processing portion and outputs a final output signal; and a weighted vector calculation portion, wherein the weighted vector calculation portion:

calculates, from the digital input signals, a weighted vector that comprises the weighted vector elements;

selects the representative digital input signal for each sub-array group from among the digital input signals; and calculates and outputs the magnitude and phase of the selected representative digital input signal for each sub-array group.

2. The wireless fading-channel demodulator of claim 1, wherein the receiving-converting portion comprises a plurality (M) of beamformers that each convert analog communication signals received from one of the corresponding M sub-array groups into the digital input signals and generate one of the M diversity beamforming signals using the digital input signals and the corresponding weighted vector elements;

and wherein each of the beamformers comprises:

analog-to-digital converters that convert L analog communication signals received via a corresponding one of the M sub-array groups into L digital input signals and output the L digital input signals;

multipliers that multiply the L digital input signals by the corresponding weighted vector elements and that output L products; and an adder that sums the L products that are output from the multipliers, and outputs one of the M diversity-beamforming signals.

3. The wireless fading-channel demodulator of claim 1, wherein each of the M sub-array groups comprises a plurality (L) of antennas in a sub-array that receive wireless fading channel signals, and the spacing between the L antennas in each sub-array group is smaller than the spacing between the M sub-array groups.

4. The wireless fading-channel demodulator of claim 1, wherein the weighted vector is calculated using the following equations:

$$u_m=[u_{m1}, u_{m2}, \ldots, u_{mL}]^T$$

$$R_m=E[u_m\, u_m^H]$$

$$w_{m,opt} = \frac{R_m^{-1} s_{ml}}{s_{ml}^H R_m^{-1} s_{ml}}$$

where $u_{mL}$ denotes an $L^{th}$ digital input signal of an $m^{th}$ sub-array group, E[ ] denotes the mean value, $w_{m,opt}$ denotes a weighted vector for the $m^{th}$ sub-array group, and $s_{m1}$ denotes a steering vector based on the direction-of-arrival of a representative digital input signal from the $m^{th}$ sub-array group.

5. A signal receiving system for mobile communications, the system comprising:

a plurality (M) of sub-array groups, wherein each of the M sub-array groups includes a plurality (L) of antennas in a sub-array and receives wireless signals via assigned wireless channels;

a radio frequency module unit that extracts analog communication signals from the received wireless signals and outputs the extracted analog signals as sub-array group analog communication signals; and a wireless fading-channel demodulation unit that receives and converts the sub-array group analog communication signals into digital input signals, generates M diversity-beamforming signals using the digital input signals and weighted vector elements, and outputs a final output signal by using the magnitude and phase of a representative digital input signal selected for each of the M sub-array groups and a corresponding one of the M diversity-beamforming signals.

6. The signal receiving system of claim 5, further comprising a relay processor that processes the final output signal to relay wireless communications between mobile stations over the assigned wireless channels.

7. The signal receiving system of claim 5, further comprising a display signal output unit that processes the final output signal to output a display signal that drives a display device of a mobile station.

8. The signal receiving system of claim 5, wherein the wireless fading channel demodulation unit comprises:

a diversity-beamforming portion that receives and converts the sub-array group analog communication signals, which are received via M sub-array groups, into digital input signals, multiplies the digital input signals by corresponding weighted vector elements, and sums the products for each one of M sub-array groups, to generate M diversity-beamforming signals;

a signal magnitude and phase processing portion that multiplies the magnitude and phase of a representative digital input signal for each sub-array group by the corresponding diversity-beamforming signal and outputs M products;

a final beam output portion that sums the M products output from the signal magnitude and phase processing portion and outputs a final output signal; and a weighted vector calculation portion wherein the weighted vector calculation portion:

calculates, from the digital input signals, a weighted vector that comprises the weighted vector elements;

selects one representative digital input signal for each sub-array group from among the digital input signals; and calculates and outputs the magnitude and phase of each of the selected representative digital input signals.

9. The signal receiving system of claim 8, wherein the diversity-beamforming portion comprises a plurality of beamformers that each convert L analog communication signals received from one of the corresponding sub-array groups into L digital input signals and generate one diversity-beamforming signal using the L digital input signals and L of the weighted vector elements;

and wherein each of the beamformers comprises:

analog-to-digital (A/D) converters that convert the analog communication signals received via the corresponding sub-array groups into L digital input signals and output the L digital input signals;

multipliers that multiply each of the L digital input by a corresponding one of the weighted vector elements and outputs L products; and an adder that sums the L products that are output from the multipliers, and outputs one of the M diversity-beamforming signals.

10. The signal receiving system of claim 5, wherein the spacing between the antennas in each sub-array group is smaller than the spacing between the sub-array groups.

11. A method for demodulating a signal transmitted over a wireless channel, the method comprising:

(a) receiving and converting sub-array group analog communication signals, which are received via M sub-array antenna groups, into digital input signals, multiplying the digital input signals by corresponding weighted vector elements, and summing the products for each sub-array group to generate M diversity-beamforming signals;

(b) multiplying the magnitude and phase of a representative digital input signal for each sub-array group by the corresponding diversity-beamforming signal and outputting the products;

(c) summing all of the products obtained in step (b) to output a final output signal; and (d) calculating, from the digital input signals, a weighted vector that comprises the weighted vector elements; selecting one representative digital input signal from among the digital input signals for each of the M sub-array groups; and calculating and outputting the magnitude and phase of each of the M selected representative digital input signals.

12. The demodulation method of claim 11, wherein step (a) comprises: converting L analog communication signals received via each one of the M sub-array groups into L digital input signals;

multiplying each of the L digital input signals for each sub-array group by L of the corresponding weighted vector elements and outputting L products;

summing the L products for each one of the sub-array group and outputting one of the M diversity-beamforming signals.

13. The demodulation method of claim 11, wherein each of the M sub-array groups comprises a plurality (L) of antennas in a sub-array, and the spacing between the L antennas in each sub-array group is smaller than the spacing between the M sub-array groups.

14. The demodulation method of claim 11, wherein the weighted vector is calculated using the following equations:

$$u_m=[u_{m1}, u_{m2}, \ldots, u_{mL}]^T$$

$$R_m=E[u_m\, u_m^H]$$

$$w_{m,opt} = \frac{R_m^{-1} s_{mI}}{s_{mI}^H R_m^{-1} s_{mI}}$$

where $u_{mL}$ denotes an $L^{th}$ digital input signal of an $m^{th}$ sub-array group, E[ ] denotes the mean value, $w_{m,opt}$ denotes a weighted vector for the $m^{th}$ sub-array group, and $s_{m1}$ denotes a steering vector based on the direction-of-arrival of a representative digital input signal from the $m^{th}$ sub-array group.

15. A signal receiving method for mobile communications, the method comprising:

(a) receiving wireless signals via a plurality (M) of antenna sub-array groups, each of which antenna groups includes a plurality (L) of antennas in a sub-array;

(b) extracting analog communication signals from the received wireless signals and outputting the extracted analog signals as sub-array group analog communication signals; and (c) converting the sub-array group analog communication signals into digital input signals, generating M diversity-beamforming signals from the digital input signals and weighted vector elements, and outputting a final output signal generated by multiplying the magnitude and phase of a representative digital input signal of each of the M sub-array groups by a corresponding one of the M diversity-beamforming signals.

16. The signal receiving method of claim 15, further comprising processing the final output signal to relay wireless communications between mobile stations over the assigned wireless fading channels.

17. The signal receiving method of claim 15, further comprising processing the final output signal to output a display signal that drives a display device of a mobile station.

18. The signal receiving method of claim 15, wherein step (c) comprises:

(c1) generating the diversity-beamforming signals by multiplying the L sub-array group analog communication signals corresponding to each one of the M sub-array groups by a corresponding one of the weighted vector elements;

(c2) multiplying the magnitude and phase of a representative digital input signal for each sub-array group by the corresponding diversity-beamforming signal and outputting the products;

(c3) summing all of the products to output the final output signal; and (c4) calculating the weighted vector, comprising (M×L) weighted vector elements, from the digital input signals; selecting M representative digital input signals from among the digital input signals; and calculating the magnitude and phase of each of the M selected representative digital input signals.

19. The signal receiving method of claim 18, wherein step (c1) comprises:

converting the analog communication signals into the digital input signals;

multiplying the digital input signals for each sub-array group by the corresponding weighted vector elements and outputting the products; and summing the products for each sub-array group to output one of the diversity-beamforming signals.

20. The signal receiving method of claim 15, wherein the spacing between the L antennas in each of the M sub-array groups is smaller than the spacing between the sub-array groups.

* * * * *